United States Patent [19]

Karbstein

[11] Patent Number: 4,472,078

[45] Date of Patent: Sep. 18, 1984

[54] FRAME FOR DRAINING DITCHES

[75] Inventor: Peter Karbstein, Dätgen, Fed. Rep. of Germany

[73] Assignee: ACO Severin Ahlmann BMGH & Co. KG, Fed. Rep. of Germany

[21] Appl. No.: 448,340

[22] Filed: Dec. 9, 1982

[30] Foreign Application Priority Data

Dec. 15, 1981 [DE] Fed. Rep. of Germany ..... 3149552

[51] Int. Cl.[3] ..... E01C 11/22

[52] U.S. Cl. ..... 404/2; 52/102; 405/119

[58] Field of Search ..... 404/2, 3, 4, 5, 8; 405/36, 119; 52/169.7, 102, 601, 255, 256, 257

[56] References Cited

U.S. PATENT DOCUMENTS

| | | | |
|---|---|---|---|
| 999,752 | 8/1911 | Connell | 52/255 |
| 2,142,305 | 1/1939 | Davis | 52/601 |
| 3,452,495 | 7/1969 | Schroeder | 52/169.7 |

FOREIGN PATENT DOCUMENTS

| | | | |
|---|---|---|---|
| 7122579 | 6/1971 | Fed. Rep. of Germany . | |
| 7340975 | 11/1973 | Fed. Rep. of Germany . | |
| 2547384 | 5/1977 | Fed. Rep. of Germany . | |
| 2407422 | 10/1977 | France . | |
| 467389 | 2/1969 | Switzerland . | |
| 2557 | of 1899 | United Kingdom | 404/8 |
| 2099477 | 12/1982 | United Kingdom | 52/102 |

*Primary Examiner*—Ernest R. Purser
*Assistant Examiner*—Mark J. Del Signore
*Attorney, Agent, or Firm*—Harness, Dickey & Pierce

[57] ABSTRACT

A frame formed of metal, for draining ditches, comprising two downward pointing legs extending in parallel spaced relationship forming between them a channel having the material in the upper region of the wall of the ditch formed integrally with it therein said legs being interconnected with each other via a web the upper surface of which forms an abutment area for a ditch covering, and a leg extending upwards from the web for holding the channel covering laterally, with the two lower legs, in particular, being provided with several recesses at the undersides thereof leaving between them projections with the recesses and projections of the one lower leg being respectively arranged to abut at least in part or at least approximately the gaps of the other lower leg.

8 Claims, 7 Drawing Figures

FRAME FOR DRAINING DITCHES

The invention relates to a frame for draining ditches, formed of metal, comprising two downward pointing legs extending in parallel spaced relationship thus forming between them a channel, with the material in the upper region of the ditch formed integrally thereinto, said legs being interconnected with each other via a web the upper surface of which forms an abutment for a ditch covering, and a leg extending upwards from the web for holding said ditch covering laterally.

A draining ditch has become known with holding members arranged at the upper edges which in addition to being disposed in close contact against the upper surface also come to lie in close contact against the side wall surface of the respective edge (German patent letter No. 1 955 737). Such holding members at the same time serve as a protection for the edges of the draining ditch and as an abutment for the covering, such as a ditch grate, for example. With the known draining ditch the holding member is fastened later on by screwing it to the outer surface of the wall of the ditch body, for example. The draining ditch on the one hand and the holding member on the other hand, with the known construction, are formed as individual components, so that additional mounting is necessary on site.

It has furthermore become known to provide frames for draining ditches with anchoring profiles formed integrally with the ditch body therein. The frame construction described in the beginning has become known in connection with draining ditches made of polyester concrete. The channel formed between the downward pointing legs has a cross section similar to a dovetail profile so that due to the poured-in polyester concrete an effective anchoring is guaranteed between the frame and the leg of the ditch.

With roads and routes laid out for heavy transport, in particular, an especially stable construction is necessary for the ditch and the retention means for the coverings, respectively, such as ditch grates, for example. What is particularly critical are the forces effective on the ditch covering created by frequent and rapid crossing with, in part, also heavy wheel loads. The extremely complicated case of loading occurring in this connection involves simultaneous stresses from alternating tension and compressive forces, bendig forces and shearing forces. Owing to the toothing between the frame and the ditch body a fast connection is indeed obtained between the latter two but, on the other hand, the cross section of the ditch wall is reduced in the critical range (notch effect).

It is therefore the object of the invention to provide a frame formed of metal for draining ditches, which may be manufactured integrally with the draining ditch but warrants the accommodation of alternating high tension and compressive forces, bending forces and shearing forces.

According to the invention this object is attained with a frame mentioned in the beginning in that both lower legs are provided with several recesses on the undersides thereof said recesses leaving projections between them, with the recesses and projections of the one lower leg being arranged at least in part or at least approximately respectively to abut the gaps of the other lower leg.

With the ditch according to the invention the outer surfaces of the lower legs are flush with the associated sides of the ditch walls and the channel formed between the lower legs is filled with the material of the ditch body such as polyester concrete, for example. Insofar, however, the construction according to the invention does not exceed the prior art. What is essential to the invention is that the underside of the lower legs does not extend in a straight horizontal line but owing to the recesses formed therein extends rising and descending with a recess of the one lower leg respectively being disposed opposite a projection of the other lower leg. The transitions between the projections and recesses preferably are steady such as in the form of waves, for example, in order to avoid sharp points of attacking at the material of the ditch body.

Owing to the design of the ditch frame according to the invention an optimal introduction into the ditch body is obtained for the forces horizontally attacking the frame because the cross section of the ditch wall opposing said forces has been increased and no smooth area of fracture will be able to form, such as is the case with the known anchoring of the ditch frames.

According to one embodiment of the invention provision is made for the length of the recesses to be approximately equal to the spaces between the projections. In this manner, it may be ensured that the projections and recesses of oppositely disposed lower legs will be arranged with the projections of the one exactly abutting the gaps of the other.

According to another embodiment of the invention provision is made for the legs to have break-throughs adjacent the recesses and/or the projections. The material of the ditch such as polyester concrete, for example, may enter into the break-throughs during the process of forming the ditch, where they may take care of a particularly effective anchoring of the frame at the ditch wall.

It goes without saying that the break-throughs may be greater in the region of the projections than in the region of the recesses.

In another embodiment of the invention provision is made for the lower legs to have unlatching means at the ends in the lower regions.

Another embodiment of the invention provides for the abutment web to have a section of greater thickness in an end region with an interlocking recess formed in the said section said recess opening towards the inner surface of the ditch. The interlocking recess serves for the accommodation of a pivotable bar fitted at the covering which may be pivoted into the recess for the fixation of the covering, for example, by means of a screw.

So as to further reduce the impact forces, provision is finally made in one embodiment of the invention for all the edges facing the ditch material to be rounded.

An example of embodiment of the invention will be explained in the following in more detail by way of drawings.

Figure 7:
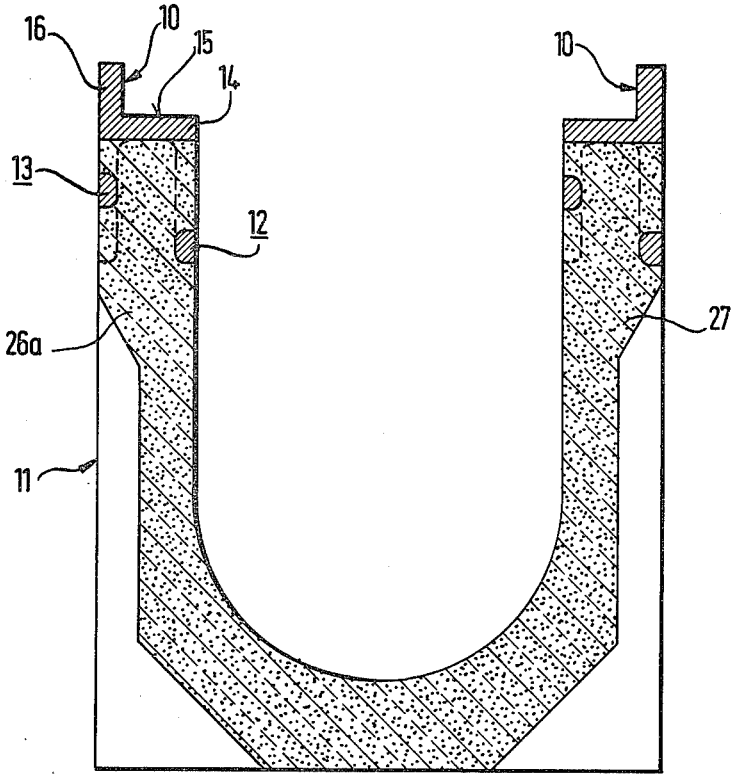
FIG. 7 shows a sectional view of a ditch body comprising frames according to the invention.

Prior to enlarging in more detail on the individual representations shown in the drawings, it has to be stated that each of the features described and shown is of inventively essential significance by itself or in connection with features of the claims. A frame 10 made of metal such as cast steel, for example, is half the length of a draining ditch 11 (FIG. 7). It has two downward pointing legs 12, 13 formed integrally with a web 14 thereat in parallel spaced arrangement with respect to each other. The web is provided with an abutment surface 15 for a ditch grate (not shown). A leg 16 projecting upwardly is formed at the upper surface of the web 14 level with the leg 13, said leg affording the ditch grate lateral support.

Figure 2:
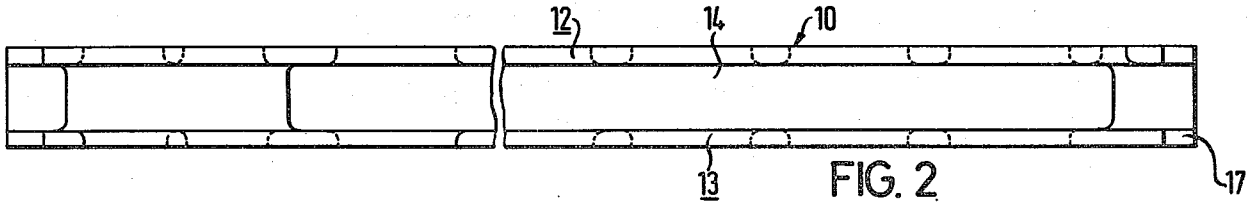
FIG. 2 shows a bottom plan view of the frame according to FIG. 1.
Figure 1:
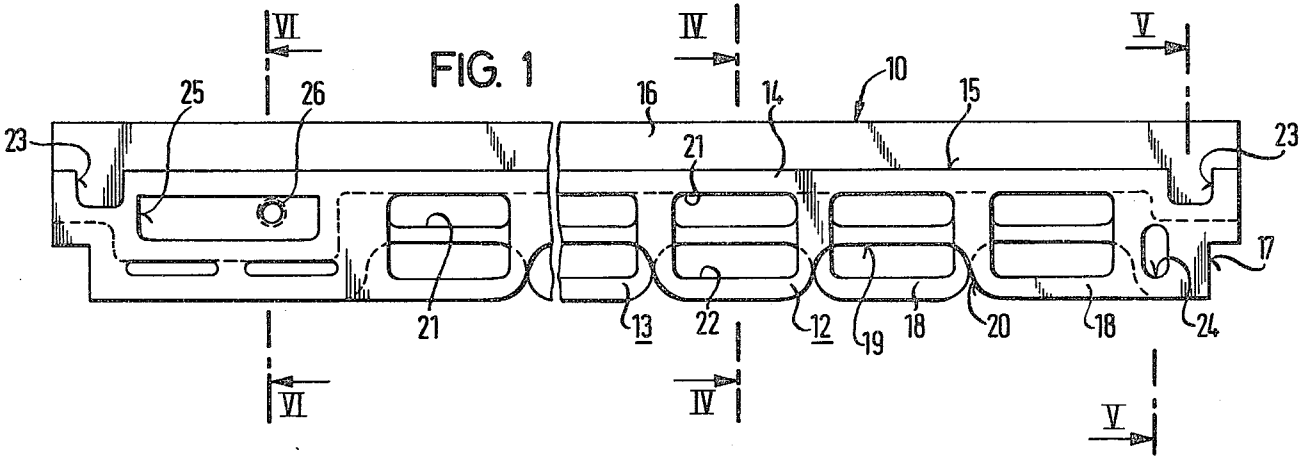
FIG. 1 shows a side view of a frame according to the invention.

As will be recognized from FIGS. 1 and 2, the side walls 12, 13 are provided with unlatching means 17 at the ends and in the lower regions thereof; said means taking care to provide some clearance when mating adjacent draining ditches by means of a groove and tongue system. With a total length of a draining ditch of 1000 mm four frames of one and the same type may be used. With this, stock keeping of frames is simplified (uniform length). Besides, the side walls 12, 13 are formed in such a manner that projections 18 and recesses 19 alternate with each other in the longitudinal direction, with the transition between a projection 18 and a recess 19 being via a wave-like line 20. FIG. 1 shows the course of the underside of the rear downward-pointing leg 13 in broken lines, as far as it is covered by leg 12. Apertures or break-throughs 21 are formed adjacent the recesses 19 with apertures or break-throughs 22 being formed adjacent the projections 18 said latter break-throughs defining a greater break-through area corresponding to the greater leg area.

Figure 3:
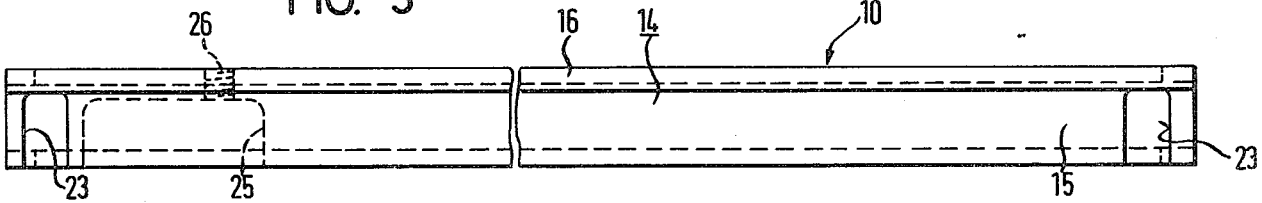
FIG. 3 shows a top plan view of the frame according to FIG. 1.
Figure 4:
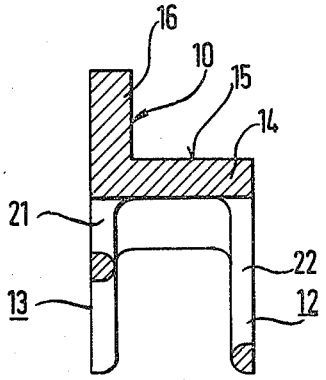
FIG. 4 shows a sectional view of the frame rotated 90° counterclockwise taken on line 4—4 of FIG. 1.
Figure 5:
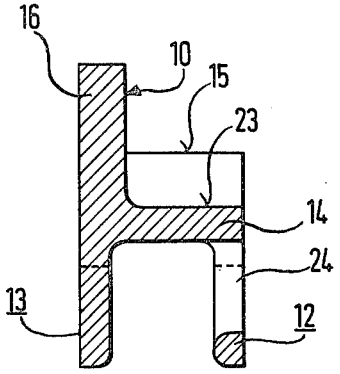
FIG. 5 shows a sectional view of the frame rotated 90° counterclockwise taken on line 5—5 of FIG. 1.
Figure 6:
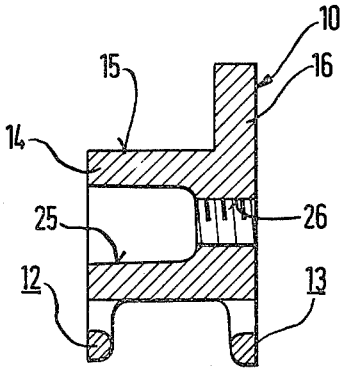
FIG. 6 shows a sectional view of the frame rotated 90° counterclockwise taken on line 6—6 of FIG. 1.

As may be derived from FIG. 1, the web 14 is provided with notches 23 at the ends thereof which are formed in a reinforced section of the web 14 accommodating correspondingly shaped projections of the ditch grate, in order to secure the latter against displacement in a longitudinal direction. Leg 12 is provided with a break-through 24 adjacent the notches 23 at the right-hand end of FIG. 1. In the left-hand region the web 14 is formed as a section of greater thickness. On the side facing away from the upper leg 16 an elongated horizontal recess 25 is formed laterally in the said section (see FIGS. 1, 3 and 6). When connected to a ditch wall said recess 25 points towards the interior of the ditch. It serves for the accommodation of a pivotable bar of the channel covering (not shown). To the opposite side of the frame 10 the recess is connected via threaded bore 26. It serves to accommodate a threaded screw to which a concrete anchor may be connected. In this manner it is possible to additionally anchor frame and ditch body when being fitted in the concrete on site.

From FIG. 7 it may be recognized how the frame 10 is integrated with the walls **26*a*, 27 of a ditch body consisting of polyester concrete. It will be seen that the outer surfaces of the lower legs 12, 13 and of the upper leg 16 are flush with the facing sides of the walls 26*a*, 27. It will furthermore be recognized that the ditch material is integrated by working it into the channel formed between the lower legs 12,13 and has also entered into the break-throughs 21, 22. From FIG. 7, the particularly advantageous anchoring of the frame 10**, too, becomes clear as regards the absorption of forces.

From FIGS. 4 to 7 it is recognizable particularly clearly that the frame 10 is provided with distinct rounded formations at all the edges thereof facing the ditch material.

I claim:

1. A frame formed of metal adapted to be cast into an upright leg of draining ditches, comprising two downward pointing legs in parallel spaced arrangement forming between them a channel adapted to receive the cast material of the ditch, said legs being integrally connected with each other via a web, the upper surface of said web forming an abutment area for supporting a ditch covering, and a leg extending upwards from the web in opposition to said downwardly pointed legs for holding the ditch covering laterally, characterized in that both downward legs are provided with several spaced recesses extending only partially therethrough and leaving between them projections with the recesses and projections of one downward leg being staggered in a lengthwise relation to those of the other downward leg.

2. A frame according to claim 1, characterized in that the length of the recesses approximately equals the length of the projections.

3. A frame according to claim 2, characterized in that the legs are provided with openings adjacent the recesses and the projections.

4. A frame according to claim 3, characterized in that the openings adjacent the projections are double the size of the openings adjacent the recesses.

5. A frame according to claim 4, characterized in that the lower legs are provided with notches at the ends in the lower region.

6. A frame according to claim 5, characterized in that the abutment web has a section of increased thickness adjacent one end thereof with an interlocking recess formed therein opening towards the inner surface of the channel.

7. A frame according to claim 6, characterized in that the interlocking recess opens to the opposite side of the frame via a threaded bore.

8. A frame according to claim 1, characterized in that all the edges facing the material of the ditch are rounded.

* * * * *